United States Patent [19]

Caldwell et al.

[11] Patent Number: 5,067,617

[45] Date of Patent: Nov. 26, 1991

[54] EARRING STORAGE AND DISPLAY RACK

[76] Inventors: Dean Caldwell, 4524 SE. Naef Rd., Milwaukie, Oreg. 97267; Ginny Bass, 2707 SE. 35th Pl., Portland, Oreg. 97202

[21] Appl. No.: 590,154

[22] Filed: Sep. 28, 1990

[51] Int. Cl.[5] ..... A47F 5/00

[52] U.S. Cl. ..... 211/13; 211/113; 211/87; 206/495

[58] Field of Search ..... 211/13, 113, 87; 206/495, 6.1

[56] References Cited

U.S. PATENT DOCUMENTS

| | | | |
|---|---|---|---|
| D. 248,801 | 8/1978 | Tafoya | D6/25 |
| D. 251,340 | 3/1979 | Strasser | D6/28 |
| D. 252,302 | 7/1979 | Persky | D6/157 |
| D. 291,520 | 8/1987 | Melvin | D6/571 |
| D. 291,641 | 9/1987 | Farley | D6/566 |
| 4,264,013 | 4/1981 | Vollmer | 211/13 |
| 4,775,053 | 10/1988 | Geiger | 211/13 |
| 4,776,650 | 10/1988 | Ferenzi | 312/245 |

*Primary Examiner*—Robert W. Gibson, Jr.
*Attorney, Agent, or Firm*—Edward B. Watters

[57] ABSTRACT

An earring rack adapted for mounting on a wall or door and comprising a framework of vertical members and horizontal cross members. The cross members are provided with slots and apertures for hanging and displaying earrings. In one embodiment of an improved slotted aperture a hole defined in the cross member near its lower edge is intersected by a downwardly extending slot which allows ingress to and egress from the hole. The intersecting hole and slot define a hook-like element in the body of the cross member in which an earring can be conveniently hung.

17 Claims, 2 Drawing Sheets

EARRING STORAGE AND DISPLAY RACK

This application is related to our copending application Ser. No. 590,090 filed Sept. 28, 1990.

BACKGROUND OF THE INVENTION

This invention relates to storage devices, and more particularly to a rack for storing and displaying earrings.

Earrings generally comprise an ornamental body and an earpiece. "Earpiece" is defined herein as that portion of an earring which facilitates attachment to the earlobe by grasping the earlobe or by extending through a hole pierced in the earlobe. Earrings can be classified generally according to three types of earpiece: clasp, post and wire, each defined as follows. A "clasp" earring comprises an earpiece attached to the ornamental body of the earring, which earpiece includes a pivoted or spring biased member adapted to grasp the earlobe. A "post" earring comprises an earpiece having a pin or wire element, termed a post, which protrudes posteriorly a short distance outward from the ornamental body of the earring and is adapted for extending through the hole of a pierced earlobe, the earpiece further including a separate threaded or frictional retaining member which grips the post. The ornamental body of a "wire" earring attaches to and depends from the earpiece, which comprises an arcuate wire shaped like a hook or forming a loop, the wire adapted to extend through the hole of a pierced earlobe; the wire hook or loop may include a closure formed integrally by the wire or otherwise by separate elements attached thereto. In a variation of the wire earring, the ornamental portion of the earring and the wire earpiece together form a large loop or toroid, which opens at the earpiece for attachment to the earlobe.

Earring racks adapted for mounting on a planar surface such as a wall or a door are preferably relatively thin in cross section so that they can be mounted in a confined area without taking an inordinate amount of space, and so that a broad surface area is provided for displaying the jewelry and facilitating ease of selection of a particular item. Such racks, which are functional as well as attractive, generally comprise a framework of vertical members or stanchions having two or more horizontal cross members, and provided with means for retaining and storing the earrings. See for example, our copending application Ser. No. 07/148,222 for an ornamental design of an earring rack, now U.S. Pat. No. D310,926. Other storage racks are shown in the following U.S. Pat. Nos.:

D248,801, Tafoya, 8/1978
D251,340, Strasser, 3/1979
D252,302, Persky, 7/1979
D291,520, Melvin, 8/1987
D291,641, Farley, 9/1987
4,264,013, Vollmer, 4/1981
4,775,053, Geiger, 10/1988
4,776,650, Ferenzi, 10/1988

Means provided on a rack for storing and retaining earrings typically include a plurality of upwardly extending slots cut through cross members of the rack along the top edges thereof. Such slots facilitate the storing especially of post earrings, although some wire earrings also can be stored in the slots, and some clasp earrings as well if the earpiece or clasp is narrow enough to fit into the slot. However, hanging the earpiece of a wire earring over the cross members into a slot and removing it therefrom has been found to be awkward and inconvenient because the ornamental body of the earring can interfere with placement of the earpiece, and if the wire earring includes a closure, the closure can cause additional interference.

Wire earrings as well as clasp earrings are more conveniently hung from holes cut through the rack cross members near the lower edges thereof. The earpiece of a clasp earring must first be opened and inserted through the hole, and wire earrings having a closure must likewise be opened in order to insert the earpiece through the hole. Post earrings can also be stored by means of the holes in the cross members by removing the retaining member from the post, inserting the post through the hole, and reinstalling the retaining member on the post from behind the cross member; however, this also has proven to be awkward and inconvenient.

A problem associated with the present invention relates to the storage of larger earrings such as those which form a toroid or circular shaped ornamental body. Such large earrings, which can be of any of the three types, post, wire or clasp, when stored in the slots or holes, usually protrude too far from the face of the rack and are likely to be bumped, which could damage the earring or the rack, or both. Moreover, larger earrings comprising closed rings or toroidal elements cannot easily be hung from upwardly extending slots because the rings cannot be fit around the cross member, which is continuous across the face of the rack, i.e. not cantilevered. Large earrings are therefore most conveniently hung from a hook or a hook-like element on the rack. Hooks, generally of metal, are provided for such purpose on many racks; however, such hooks protrude from the surface of the rack structural elements and are thus conducive to snagging as by clothing, particularly when the rack is mounted on a door or within the close confines of a closet or dressing room. Cross members of the racks are made as thin as practicable in order to maintain the slender depth of the rack, therefore hooks are difficult to anchor securely into the rack members, especially when the rack is made of wood. Further, protruding hooks, particularly metal hooks on a rack made of wood, detract from the esthetic appearance of the rack.

In view of the foregoing, it is a primary object of the present invention to provide an improved rack for storing and displaying earrings.

Another object of the invention is to provide an earring storage and display rack having improved means for hanging large earrings.

It is a further object of the invention to provide an improved earring storage and display rack that is both functional and attractive, the functional object being to provide an improved hook-like element from which to hang earrings, without detracting from the esthetic appeal of the rack.

SUMMARY OF THE INVENTION

In accordance with the present invention, an earring rack is provided which is adapted for mounting on a wall or door and includes a framework of vertical members and horizontal cross members. In one embodiment of the invention an improved slotted aperture for hanging an earring is provided by a hole defined in the cross member near its lower edge and a downwardly extending slot which intersects the hole and extends to the lower edge of the cross member, allowing ingress to and egress from the hole. The intersecting hole and slot define a hook-like element in the body of the cross member in which an earring can be conveniently hung.

In an alternative embodiment of the invention, the downwardly extending slot is diagonally oriented at an angle less than 90° with respect to the horizontally disposed lower edge of the cross member.

In another embodiment of the invention, the slotted aperture is formed by a hole defined in the cross member near a lower edge thereof and a slot further defined in the cross member which intersects the lower edge and extends upward therefrom to intersect a peripheral edge of the hole at a point thereon above the closest approach of the hole to the lower edge of the cross member, the upper edge of the slot intersecting the hole tangentially, the intersection of the slot and hole defining an opening therebetween at least as wide as the width of the slot, whereby an arcuate saddle is defined in the cross member along the lower edge of the hole with ingress to and egress from the hole provided through the slot.

BRIEF DESCRIPTION OF THE DRAWING

While the invention is set forth with particularity in the appended claims, other objects, advantages and features of the invention will become more apparent, and the invention will best be understood by referring to the following detailed description in conjunction with the accompanying drawing in which:

DESCRIPTION OF THE PREFERRED EMBODIMENT

Figure 1:
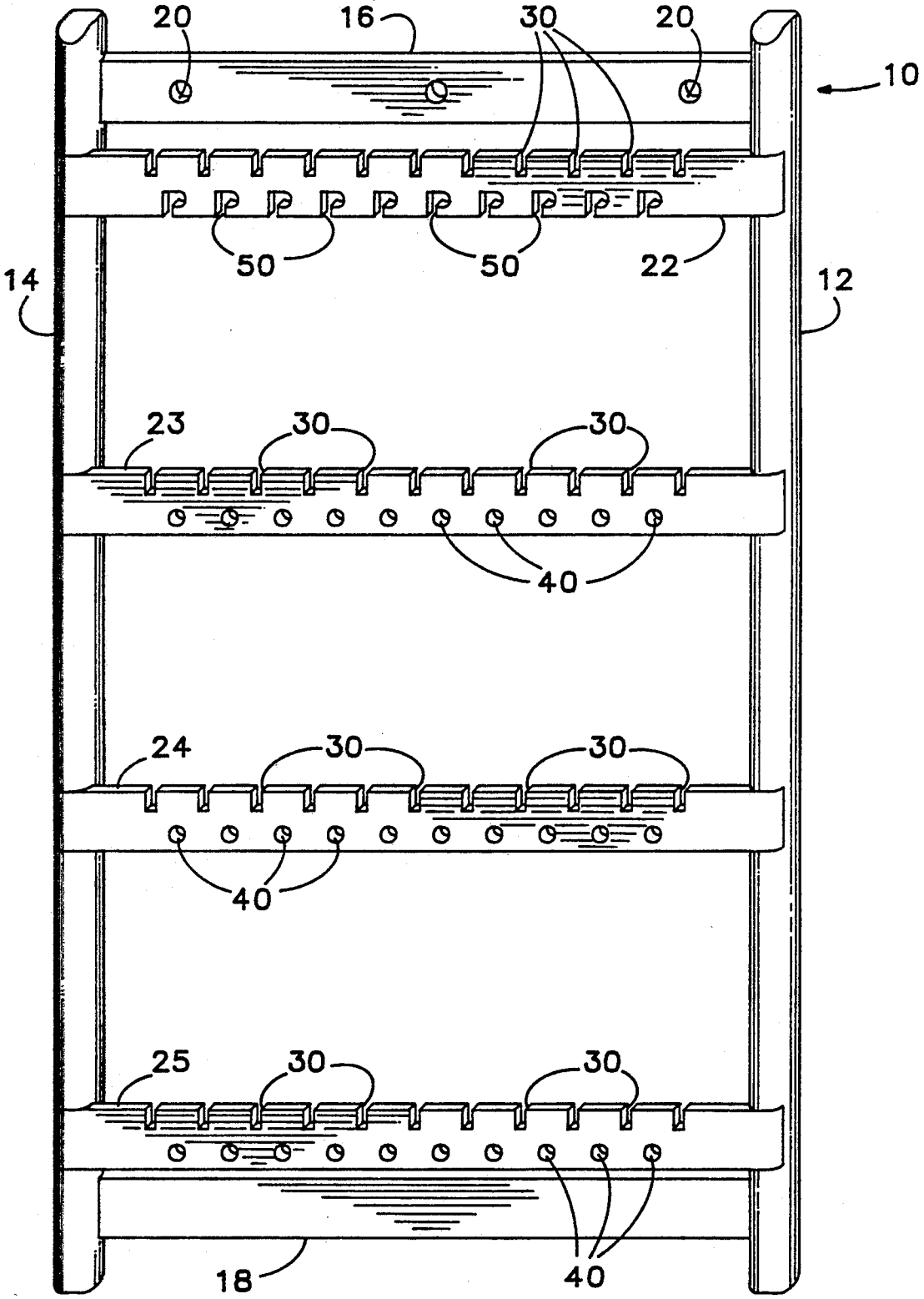
FIG. 1 is a perspective view of an earring rack according to the instant invention.

Referring now to the various views of the drawing for a more detailed description of the components, materials, construction, function, operation and other features of the instant invention by characters of reference, wherein like reference numbers denote like elements, FIG. 1 illustrates an earring rack 10 having two upright elements or stanchions 12, 14 between which are attached posteriorly thereof an upper posterior cross member 16 and a lower posterior cross member 18. Apertures 20 are provided through the upper posterior cross member 16 for attaching the rack 10 to a vertical planar surface such as a wall or a door by means of fasteners (not shown). Anterior cross members 22–25, which are spaced apart vertically, are attached at either end thereof to the upright elements 12, 14. The posterior cross members 16, 18 provide primary structural support for the rack 10, while the anterior cross members 22–25, in addition to serving as structural members, are provided with means for storing and displaying earrings as described below.

The stanchions 12, 14 are suitably 36 centimeters (14 inches) long, 1.2 centimeters (½ inch) wide, and 1.9 centimeters (¾ inch) deep, and have rounded edges. Posterior and anterior cross members are suitably 19.5 centimeters (7⅝ inches) long and 1.9 centimeters wide, while the posterior cross members are 4.5 millimeters (11/64 inch) thick and the anterior cross members are 3 millimeters (7/64 inch) thick. The stanchions 12, 14 are suitably mortised to receive the ends of all the cross members, which ends are rounded to conform with the rounded edges of the stanchions.

While the rack 10 is preferably made of hardwood such as oak, maple, koa or alder, other materials such as plastic or sheet metal and coniferous wood can be used.

Figure 2:
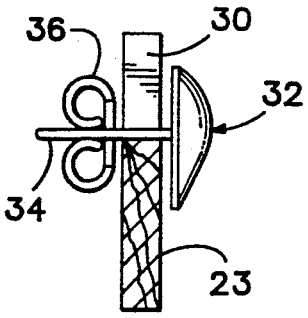
FIG. 2 is a cross section detail of the earring rack illustrating a post earring mounted in an upwardly extending slot of the earring rack.

The anterior cross members 22–25 are each provided with a plurality of vertically oriented slots 30, eleven slots through each cross member 22–25 in the presently described embodiment of the invention, the slots being regularly spaced apart longitudinally along the cross members and opening on the upper edge of each of the anterior cross members 22–25. The slots are suitably 2.5 millimeters (3/32 inch) wide and 6 millimeters (¼ inch) deep, and are spaced apart 14.3 millimeters (9/16 inch). Post earrings are conveniently stored in the slots 30 as illustrated in FIG. 2, which shows a post earring 32 having a pin 34 resting in a representative one of the slots 30 in cross member 23. A retaining member 36 which grips the pin 34 holds the earring 32 in the slot.

Figure 3:
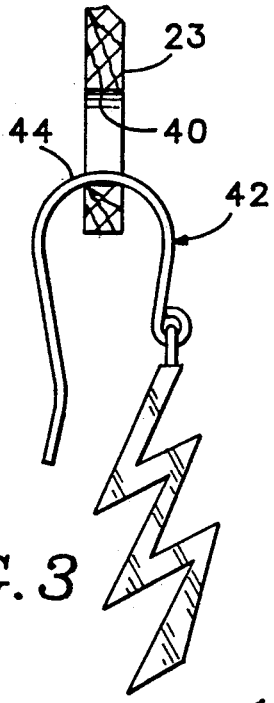
FIG. 3 is a cross section detail of the earring rack showing a wire earring hanging from an aperture of the earring rack.

The lower three anterior cross members 23–25 are each provided with a plurality of holes 40 regularly spaced apart longitudinally along the cross members, ten holes through each cross member 23–25 in the presently described embodiment of the invention. The holes 40 are suitably 5 millimeters (3/16 inch) in diameter, and spaced apart by 14.3 millimeters, the centers of the holes being located 5 millimeters above the lower edges of each of the cross members 23–25. The holes 40 and slots 30 are staggered alternately along the cross members. Wire earrings are conveniently stored in the holes 40 illustrated in FIG. 3, which shows a wire earring 42 having an earpiece 44 hanging through a representative one of the holes 40 in the anterior cross member 23.

Figure 4:
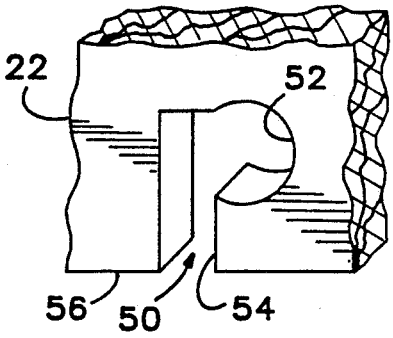
FIG. 4 is an enlarged detail in perspective of a slotted aperture in accordance with the instant invention.

The topmost anterior cross member 22 is provided with a plurality of slotted apertures 50 regularly spaced apart along the lower edge of the cross member 22 in a similar manner as the holes 40 in the other anterior cross members 23–25. Referring to FIG. 4, the configuration of a representative one of the slotted apertures 50 is shown in greater detail comprising a hole 52 through the cross member 22, and a slot 54 opening on the lower edge 56 of anterior cross members 22. The hole 52 is located near the lower edge 56 of the cross member 22, the slot 54 being vertically oriented with respect to the longitudinal dimension of the cross member 22 and intersecting the periphery of the hole 52 on one side thereof.

Figure 5:
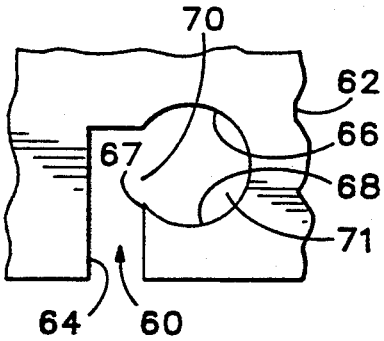
FIG. 5 is a cutaway plan view of a cross member of the earring rack according to the present invention showing one embodiment of a slotted aperture.

Referring to FIG. 5, a slotted aperture 60 formed in cross member 62 comprises a slot 64 and a hole 66. The hole 66 is suitably drilled through the cross member 62. The slot 64 is vertically oriented with respect to the horizontal or longitudinal dimension of the cross member 62, and is suitably formed as the kerf of a saw blade. The hole 66 is intersected by the kerf 64 at a point 67 on the peripheral edge of the hole 66 above the lowest point 68 of the hole 66. The slot 64 is cut to intersect the hole 66 so that the intersection forms an opening 70 in the peripheral wall of the hole 66, which opening 70 is at least as wide as the slot 64, thus providing ingress to and egress from the hole 66 through the slot 64. The slot 64 intersects hole 66 to form an arcuate saddle 71 at the lower portion of hole 66 below point 67 thus facilitating retention of earrings inserted through the slot 64 and into the hole 62 for hanging therein. The slot 64 is suitably 2.5 millimeters wide; the hole 66, 5 millimeters in diameter and located 5 millimeters above the lower edge 72 of the cross member 62 to the center of the hole.

Figure 6:
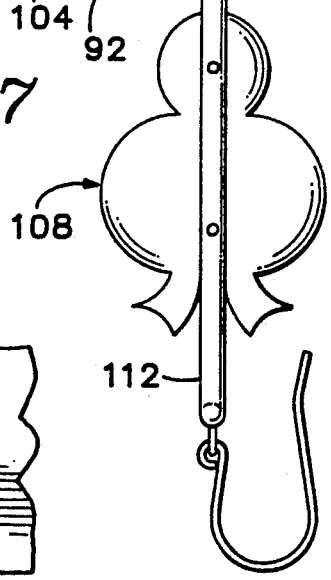
FIG. 6 is a cutaway plan view of a cross member of the earring rack according to the present invention showing an alternative embodiment of a slotted aperture.
Figure 6:
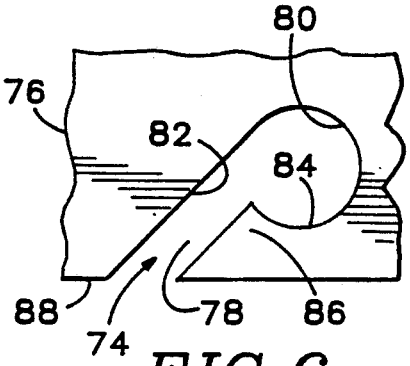

Referring to FIG. 6, an alternative embodiment of a slotted aperture 74 formed in a cross member 76 comprises a slot 78 oriented diagonally with respect to the horizontal dimension of the cross member at approximately a forty-five degree angle, and a hole 80 tangentially intersecting upper edge 82 of the angled slot 78. The lower peripheral edge 84 of the hole 80 forms an open hook-like member 86 in the body of the cross member 76 accessible from the lower edge 88 thereof through the angled slot 78. Earrings or other items of jewelry having a ring or toroidal element can be conveniently slipped through the slot 78 onto the hook-like member 86 for storage and display.

Figure 7:
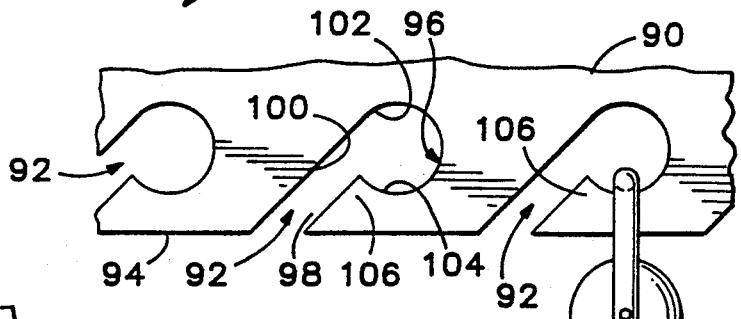
FIG. 7 is a cutaway plan view of a cross member of the earring rack in accordance with the present invention showing another embodiment of slotted apertures for hanging earrings.

Referring to FIG. 7, an anterior cross member 90 of an earring rack according to the present invention includes a plurality of slotted apertures 92 regularly spaced apart along lower edge 94 of the cross member 90. Each of the slotted apertures 92 comprises a hole 96 which is suitably drilled through the cross member 90, and a slot 98 oriented diagonally with respect to the horizontal dimension of the cross member 90 at approximately a thirty degree angle. The slots 98 are suitably cut in cross member 90 by means of a saw blade of the desired thickness or a perturbating saw blade set to cut a slot of the desired width. The upper edge 100 of the angled slot 98 tangentially intersects the upper peripheral edge 102 of the hole 96. The lower peripheral edge 104 of the hole 96 forms the saddle of an open hook-like member 106 in the body of the cross member 90 accessible from the lower edge 94 through the angled slot 98 therein. An earring 108 having a relatively large ring or toroidal element 110 can be conveniently slipped through the slot 98 onto the hook-like member 106 for storage and display. The convenience and advantage of the earring rack according to the instant invention is seen from FIG. 7 wherein an earring such as the earring 108 can be translated from left to right along the lower edge 94 of the cross member 90, even in the darkness of an unlit room, until the ring 112 encounters and enters one of the slotted apertures 92. The necessity for tactilely locating a hole or slot and then inserting the earpiece of an earring therein is thus eliminated. It is seen also that most wire, post and clasp earrings can be easily and conveniently inserted into and stored in the downwardly extending slotted apertures of the present invention.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

We claim:

1. An earring rack of the type adapted for mounting on a vertical surface and having a framework of spaced apart vertical members with at least two horizontally disposed cross members attached to the vertical members and extending therebetween, and apertures in at least one of the cross members for storing earrings, the improvement comprising:

a downwardly extending slotted aperture through one of the cross members formed by a kerf opening at a lower edge of the one cross member and a hole through the one cross member; the hole having a peripheral edge intersected by the kerf at a point on the peripheral edge above a lowest point of the peripheral edge of the hole, whereby an arcuate saddle is defined along a lower edge of the hole with ingress to and egress from the hole provided through the kerf.

2. The earring rack according to claim 1 wherein the kerf is oriented vertically with respect to the horizontal dimension of the one cross member.

3. The earring rack according to claim 1 wherein the kerf is oriented angularly at an angle of less than 90° with respect to the horizontal dimension of the one cross member.

4. The earring rack according to claim 3 wherein an upper edge of the kerf intersects the hole tangentially.

5. The earring rack according to claim 1 wherein the kerf is angularly oriented at substantially 45° with respect to the horizontal dimension of the one cross member.

6. The earring rack according to claim 5 wherein an upper edge of the kerf intersects the hole tangentially.

7. The earring rack according to claim 1 wherein the kerf is angularly oriented at substantially 30° with respect to the horizontal dimension of the one cross member.

8. The earring rack according to claim 7 wherein an upper edge of the kerf intersects the hole tangentially.

9. An earring storage and display rack, comprising:

a framework adapted for attachment to a vertical surface and including a pair of spaced apart elongate vertical members, a pair of spaced apart elongate horizontal members attached at ends thereof to the vertical members; and means defined in at least one of the horizontal members for holding an earring, the holding means including a downwardly extending slotted aperture through one of the horizontal members defined by a kerf opening at a lower edge of the one horizontal member and a hole through the one horizontal member, the hole having a peripheral edge intersected by the kerf at a point on the peripheral edge above a lowest point of the peripheral edge of the hole, whereby an arcuate saddle is defined along a lower edge of the hole with ingress to and egress from the hole provided through the kerf.

10. In a wall mounted earring rack of the type having a framework With a flat elongate horizontally extending cross member and having means defined in the cross member for holding earrings, the improvement comprising:

a hole defined in the cross member near a lower edge of the cross member; and a slot defined in the cross member, the slot intersecting the lower edge of the cross member and extending upward from the lower edge of the cross member to intersect a peripheral edge of the hole at a point on the peripheral edge of the hole above a point thereon closest to the lower edge of the cross member, the intersection of the slot and hole defining an opening therebetween at least as wide as the width of the slot, whereby an arcuate saddle is defined in the cross member along a lower edge of the hole with ingress to and egress from the hole provided through the slot.

11. The earring rack according to claim 10 wherein the slot is oriented vertically with respect to the horizontal dimension of the cross member.

12. The earring rack according to claim 10 wherein the slot is oriented angularly at an angle of less than 90° with respect to the horizontal dimension of the cross member.

13. The earring rack according to claim 12 wherein an upper edge of the slot intersects the hole tangentially.

14. The earring rack according to claim 10 wherein the slot is angularly oriented at substantially 45° with respect to the horizontal dimension of the cross member.

15. The earring rack according to claim 14 wherein an upper edge of the slot intersects the hole tangentially.

16. The earring rack according to claim 10 wherein the slot is angularly oriented at substantially 30° with respect to the horizontal dimension of the cross member.

17. The earring rack according to claim 16 wherein an upper edge of the slot intersects the hole tangentially.

* * * * *